United States Patent [19]

Derby

[11] Patent Number: 4,878,600

[45] Date of Patent: Nov. 7, 1989

[54] STATIC CONTROLLED DISCHARGE SPOUT

[75] Inventor: Norwin C. Derby, Dallas, Tex.

[73] Assignee: Super Sack Manufacturing Corporation, Dallas, Tex.

[21] Appl. No.: 220,432

[22] Filed: Jul. 13, 1988

Related U.S. Application Data

[63] Continuation of Ser. No. 2,493, Jan. 12, 1987, abandoned.

[51] Int. Cl.[4] ..... B65D 33/38

[52] U.S. Cl. ..... 222/105; 222/181; 222/529; 222/190; 361/215; 57/901

[58] Field of Search ..... 222/105, 181, 190, 527; 57/901; 361/212, 215, 220

[56] References Cited

U.S. PATENT DOCUMENTS

| | | | |
|---|---|---|---|
| 2,193,036 | 3/1940 | McGraw | 361/215 |
| 2,361,943 | 1/1942 | Issoglio et al. . | |
| 3,445,055 | 5/1969 | Port et al. . | |
| 3,555,170 | 1/1970 | Thessalonikis et al. | 361/215 |
| 3,596,134 | 7/1971 | Burke . | |
| 3,828,112 | 8/1974 | Johansen et al. | 361/215 |
| 3,907,955 | 9/1975 | Viennot . | |
| 3,943,273 | 3/1976 | Putter | 361/215 |
| 3,961,655 | 6/1976 | Nattrass et al. . | |
| 4,107,452 | 8/1978 | Razvi . | |
| 4,143,796 | 3/1979 | Williamson et al. . | |
| 4,394,705 | 7/1983 | Blachman | 361/215 |
| 4,467,005 | 8/1984 | Pusch et al. . | |
| 4,560,608 | 12/1985 | Push et al. . | |

*Primary Examiner*—H. Grant Skaggs
*Attorney, Agent, or Firm*—Michael A. O'Neil

[57] ABSTRACT

A discharge spout on the bottom wall of a collapsible receptacle has an exterior layer which is grounded during the flow of material through the discharge spout to prevent buildup of static electric charge therein. The discharge spout is made from a metalized fabric having a lower layer of fabric. Secured to the fabric layer is an upper film layer. At least a portion of the exposed surface of the film layer is metalized or laminated with foil.

2 Claims, 2 Drawing Sheets

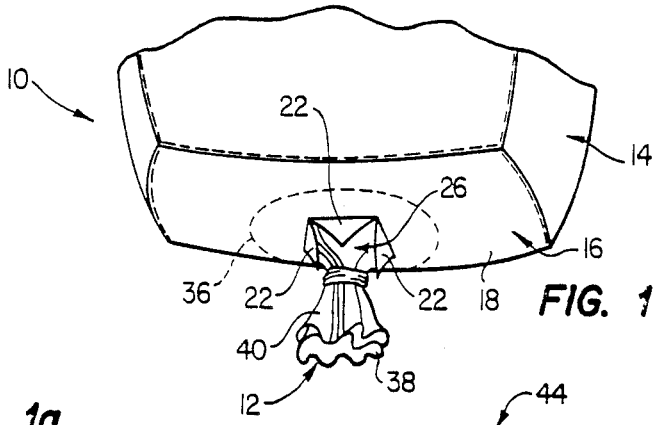
FIG. 1
FIG. 1a
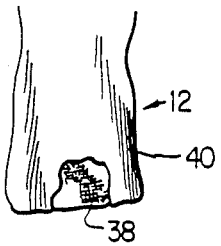
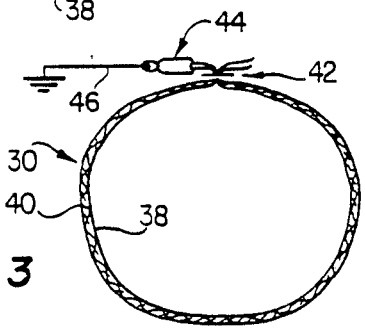
FIG. 3
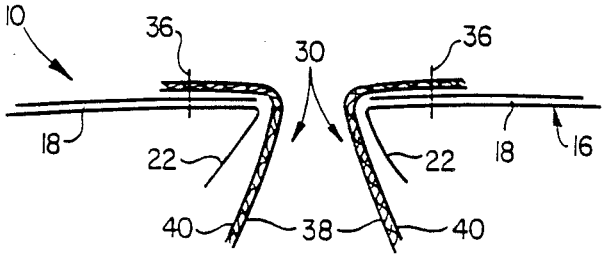
FIG. 2

STATIC CONTROLLED DISCHARGE SPOUT

CROSS-REFERENCE TO RELATED APPLICATIONS

This application is a continuation of application Ser. No. 07/002,493 filed Jan. 12, 1987 and now abandoned.

TECHNICAL FIELD

This invention relates to a collapsible receptacle which is useful in handling flowable materials in semi-bulk quantities, and more particularly to a collapsible plastic fabric receptacle having a discharge spout with a metalized outer surface to discharge static electricity.

BACKGROUND

There has been increasing interest in the use of flexible, collapsible containers for handling semi-bulk quantities of particulate, granular and other flowable materials such as chemicals, minerals, fertilizers, foodstuffs, grains, and agricultural products. The advantages of such receptacles include relatively low weight, reduced cost, better versatility, and low return freight costs in the case of reusable receptacles.

Fabrics are often used in the construction of such containers for strength, flexibility and durability. Traditionally, fabrics have been constructed of natural fibers; however, in recent years synthetic fibers manufactured from polypropylene or other plastics have come into extensive use because they are generally stronger and more durable than fabrics made of natural fiber.

The electrical characteristics of fabrics make their use undesirable in some circumstances. For example, many granular and liquid materials develop a static-electric charge through friction as they are poured into, discharged from or vibrated within a receptacle. Because fabrics are not electrically conductive, discharge of static-electricity from such materials contained by fabric receptacles is difficult, if not impossible, posing the danger of explosion or fire caused by an electrical spark.

Previously, to reduce static electricity problems, a layer of metalized fabric or a metallic laminate such as an aluminum or other electrically conductive metal foil has been secured to the fabric and the fabric was used to construct a receptacle and a discharge spout with the foil laminate or metalized layer comprising the interior surface of the receptacle and the discharge spout. The metal layers were then grounded to eliminate static electricity.

Foil laminates and metalized fabrics are, however, susceptible to abrasion, tearing and separation from the underlying fabric, particularly along the edges of the foil laminate due to contact with the contents of the receptacle as the receptacle is filled, emptied or transported. Such abrasion quickly reduces the effectiveness of the foil layer as a grounding surface and often results in unwanted contamination of the contents of the bag with foil particles or flakes.

SUMMARY OF THE INVENTION

The present invention comprises a collapsible receptacle for handling materials in semi-bulk quantities having a metalized fabric discharge spout which eliminates static electric charge from the collapsible receptacle as flowable materials are discharged. The receptacle may have any of those designs known in the art such as those disclosed in U.S. Pat. No. 4,457,456, which is incorporated herein by reference. The receptacle is formed primarily of rectangular panels of flexible but substantially inextensible material such as woven polypropylene or woven polyethylene.

According to the present invention, the bottom panel of a collapsible receptacle is provided with a discharge spout having an electrically conductive exterior surface to discharge static electricity. As materials are discharged from the receptacle, the conductive exterior surface of the spout is grounded, thereby eliminating static electric charge buildup. The electrically conductive layer of the discharge spout is a foil laminate or, preferably, the discharge spout is made of a metalized fabric formed according to the method set forth in U.S. patent application Ser. No. 785,473 filed Oct. 4, 1985, which is incorporated herein by reference.

BRIEF DESCRIPTION OF THE DRAWINGS

A more complete understanding of the invention can be had by reference to the following Detailed Description in conjunction with the accompanying Drawings, wherein:

FIG. 1A is an enlarged side view of the discharge spout of the receptacle of FIG. 1.

FIG. 1 is an illustration of the lower portion of a collapsible receptacle incorporating the discharge spout of the present invention for static electric charge elimination;

FIG. 2 is an enlarged partial sectional view showing part of the bottom wall and part of the discharge spout of the receptacle of FIG. 1;

FIG. 3 is a sectional view through the discharge spout of the receptacle of FIG. 1.

DETAILED DESCRIPTION

Figure 4:
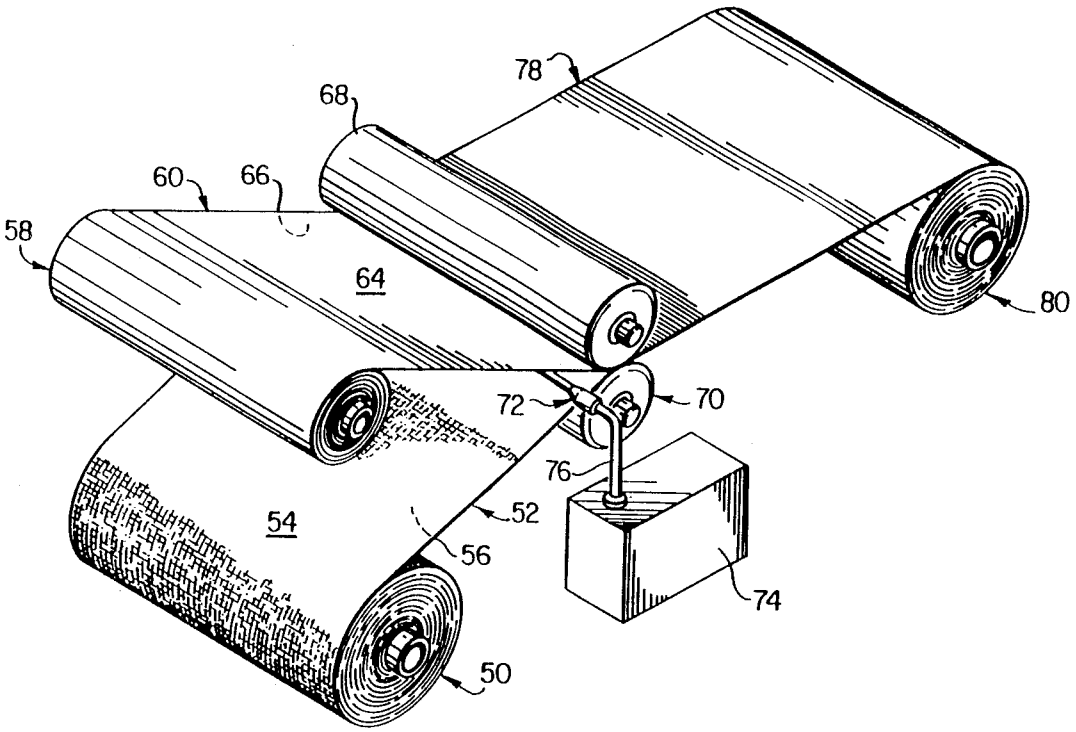
FIG. 4 schematically illustrates a preferred method of construction of fabric for the discharge spout.

Referring now to the drawings, wherein like reference numerals designate like or corresponding parts throughout the several views, and particularly referring to FIG. 1, there is shown the lower portion of a collapsible receptacle 10 incorporating a static controlled tubular discharge spout 12 according to the present invention. The receptacle 10 has a side wall 14 and a bottom wall 16 both formed from fabric material, preferably woven polypropylene or woven polyethylene. The side wall 14 comprises a rectangular piece of fabric material rolled into a tubular configuration with the overlapping edges secured to each other by sewing, adhesives or a combination of both techniques. The bottom wall 16 is secured to the lower end of the side wall 14 to close the bottom of the receptacle 10.

The bottom wall 16 comprises a fabric layer 18 which is secured to the side wall 14, such as by means of sewing. Perpendicular slits are formed in the fabric layer 18 to define a plurality of flaps 22 which in turn define a rectangular opening 26 in the fabric layer 18. The tubular discharge spout 12 is provided with a flange at its upper end which is secured to the interior of the fabric layer 18 along a line of stitching 36.

As illustrated in FIGS. 1, 2 and 3, the discharge spout 12 has a woven fabric interior layer 38 and an electrically conductive exterior layer 40. As is best shown in FIG. 3, the discharge spout 12 is formed from a rectangular piece of fabric rolled into a cylinder with the edges joined by means of a seam 42. A typical alligator-type connector 44 forms an electrical connection with the conductive layer 40 and is in turn connected by a lead 46 to a source of ground potential. Those skilled in the art will appreciate the fact that various other conventional techniques may be used to ground the discharge spout 12 and conductive layer 40.

In earlier collapsible receptacles with no grounded conductive layer, static charges of up to 200,000 volts developed. This static electricity created a significant fire and safety hazard. In the the receptacle shown in FIGS. 48–50 of U.S. Pat. No. 4,457,456, a grounded inner conductive layer is used to eliminate the static electric charge. However, the inner layer of the receptacle is subject to deterioration through abrasive wear and tear.

The conductive layer 40 of the discharge spout 12 is grounded during the discharge of material therethrough. This prevents a buildup of static electric charge within the material as it is discharged from the collapsible receptacle 10 through the discharge spout 12. By maintaining the conductive layer 40 at ground potential, the static electric charge buildup from material flowing out of the receptacle 10 is grounded and eliminated. In the present invention, grounding the conductive layer 40 eliminates the static electricity problem without wear and tear on the conductive layer 40 because the conductive layer 40 is not in contact with the material moving through the spout 30. It is presently not understood exactly why grounding the exterior surface of the discharge spout results in the elimination of static.

The receptacle 10 is preferably manufactured as described in U.S. Pat. No. 4,457,456. Discharge spout 12 is similar to the discharge spout assembly 582 illustrated and described in FIGS. 48–50 of U.S. Pat. No.4,457,456.

Collapsible receptacle 10 may be constructed of any strong, flexible and substantially inextensible material. Natural or synthetic woven material such as jute, cotton, polyethylene, or polypropylene are examples of such materials. Woven polypropylene material is advantageous because of its strength, durability and puncture resistance.

The receptacle 10 is useful for handling semi-bulk quantities of virtually any flowable material, including minerals, chemicals, fertilizers, foodstuffs, agricultural products and the like. The receptacle 10 is simply constructed and is therefore less expensive than collapsible receptacles incorporating other static discharge methods.

FIG. 4 schematically illustrates the construction of the metalized fabric preferably used in constructing the discharge spout 12 of the present invention. A roll 50 comprises a length of plastic fabric 52, such as woven polyethylene or polypropylene, having an upper surface 54 and an opposing lower surface 56. Supported above the roll 50 of plastic fabric is a roll 58 comprising a length of plastic film 60 having a metalized upper surface 64 and a lower surface 66. The length of fabric 52 and the length of film 60 are manufactured from the same type of plastic. The film 60 is oriented in two substantially perpendicular directions, thereby strengthening the film against tearing or breaking.

The upper surface 64 of the length of film 60 is metalized continuously along its entire length by conventional methods to a level which is electrically conductive. For example, one such method includes vaporization of an electrically conductive metal in a vacuum. The surface 64 of the length of film 60 is exposed to the metallic vapors within the vacuum while opposing electrical charges are imposed on the metal vapor and the film 60. The opposing charge causes the vapor to deposit or plate onto the film, forming a strong bond therebetween.

Typically, a metallic layer no more than one or two atoms thick is required to provide an electrically conductive surface. In the embodiment shown, aluminum is deposited on the length of film 60 due to its relatively low melting point and low cost. However, other electrically conductive metals, such as gold, silver, chromium, and the like may be used.

The film 60 is extrusion laminated to the fabric 52 by drawing the fabric 52 and the film 60 from rolls 50 and 58, respectively, through the nip between two compression rollers 68 and 70. Prior to passage of the film 60 and fabric 52 between the rollers 68 and 70, a thin layer of molten plastic of the same type from which the fabric 52 and the film 60 are manufactured is interposed between the lower, non-metalized surface of the film 60 and the upper surface 54 of the fabric 52 by a nozzle 72. Molten plastic is provided to the nozzle 72 from a supply 74 through a tube 76. As the fabric 52 and the metalized film 64 are compressed together between the rollers 68 and 70, the molten plastic partially melts both the non-metalized surface of the film 60 and the upper surface 54 of the fabric 52, resulting in a homogeneous layer of molten plastic which hardens when cooled to securely bond the film 60 to the underlying fabric 52. The resulting metalized fabric 78 exits from the compression rollers 68 and 70 and is collected on a take-up roll 80.

The fabric 78 may be cut into lengths of material to form discharge spout blanks. The discharge spout blank is rolled into a cylinder and the ends joined by the seam 42 to form a discharge spout 12 with an electrically conductive layer 40. The fabric 78 may also be used in the construction of a receptacle having an electrically conductive surface by using the techniques disclosed by U.S. Pat. No. 4,457,456. The metalized surface will also protect the fabric 78 from the harmful effects of sunlight, ultraviolet radiation or other similar radiation.

Although a preferred embodiment of the invention has been illustrated in the accompanying drawings and described in the foregoing detailed description, it will be understood that the invention is not limited to the embodiment disclosed, but is capable of numerous rearrangements, modifications and substitutions of parts and elements without departing from the spirit of the invention.

I claim:

1. A collapsible product receptacle comprising:

a tubular side wall;

a bottom wall secured to the side wall around the lower end thereof for closing the lower end of the receptacle to retain the product;

a generally pliable cylindrical discharge spout located in the bottom wall for dispensing the product, the discharge spout comprising a continuous inner layer for contact with the product to be dispensed and a continuous outer layer having a continuous inner non-metalized surface securely bonded substantially throughout to the continuous inner layer and a continuous outer surface metalized to a level that is electrically conductive to the static electricity generated by contact of the dispensed product with the inner layer, said inner layer and said inner surface of said outer layer protecting said conductive metalized surface of said spout from wear and tear induced by direct contact with the dispensed product; and means for connecting the outer conductive surface of the discharge spout to a source of predetermined electrical potential to control the buildup of static electricity in the receptacle.

2. A collapsible product receptacle comprising:

a tubular side wall;

a bottom wall secured to the side wall around the lower end thereof for closing the lower end of the receptacle to retain the product;

a pliable discharge spout located in the bottom wall for dispensing the product, the discharge spout comprising a continuous inner layer of plastic fabric for contact with the product being dispensed and a continuous outer layer of plastic material having a continuous inner surface securely bonded substantially throughout to the plastic fabric by lamination and a continuous outer surface metalized to a level that is conductive to the static electricity generated by contact of the dispensed product with the plastic fabric; and means for connecting the electrically conductive outer layer of the discharge spout to a source of predetermined electrical potential to control the buildup of static electricity in the receptacle.

* * * * *